United States Patent [19]

Murakami et al.

[11] Patent Number: 4,843,936

[45] Date of Patent: Jul. 4, 1989

[54] AUTOMATIC MUSIC PLAYER SYSTEM

[75] Inventors: Kazuo Murakami; Yukiyoshi Matsushima, both of Shizuoka, Japan

[73] Assignee: Yamaha Corporation, Hamamatsu, Japan

[21] Appl. No.: 124,998

[22] Filed: Nov. 24, 1987

[30] Foreign Application Priority Data

| | | | |
|---|---|---|---|
| Nov. 26, 1986 | [JP] | Japan | 61-282785 |
| Jan. 29, 1987 | [JP] | Japan | 62-19761 |
| Jun. 26, 1987 | [JP] | Japan | 62-98248[U] |

[51] Int. Cl.[4] ..... G10F 3/00

[52] U.S. Cl. ..... 84/107; 84/20

[58] Field of Search ..... 84/105, 107, 108, 109, 84/111, 113, 462, 19–23

[56] References Cited

U.S. PATENT DOCUMENTS

| | | | |
|---|---|---|---|
| 893,710 | 7/1908 | Crippen | 84/105 |
| 1,504,531 | 8/1924 | Thomson et al. | 84/105 X |
| 4,206,677 | 6/1980 | Ramsey | 84/107 |

FOREIGN PATENT DOCUMENTS

| | | | |
|---|---|---|---|
| 56-5190 | 1/1981 | Japan . | |
| 2910 | 2/1910 | United Kingdom | 84/107 |

*Primary Examiner*—L. T. Hix
*Assistant Examiner*—Brian W. Brown
*Attorney, Agent, or Firm*—Burns, Doane, Swecker & Mathis

[57] ABSTRACT

For easy adjustment of a key driver assembly, there is disclosed an automatic music player system having at least a recording mode and a reproducing mode and comprising (a) a piano having a keyboard provided with a plurality of keys, a sound generator mechanism operative to mechanically generate sounds when the keys are actuated, and an effector mechanism operative to affect the sound generated by the sound generator mechanism upon actuation, (b) a control unit located at the outside of the piano and operative to store a musical information produced by a keying-in on the keyboard and an operation of the effector mechanism in the recording mode and to produce drive signals based on the musical information stored therein in the reproducing mode, (c) a key driver assembly provided with a plurality of actuators corresponding to the keys, respectively, and responsive to the drive signal for selectively actuating the keys, (d) an effector driver assembly responsive to the drive signal and operative to actuate the effector mechanism, and (e) electric wires coupling the piano to the control unit and electrically connecting the control unit to the key driver assembly and the effector drive assembly, and the control unit and the key driver assembly are physically separated from each other, so that an operator can easily furnish or remove the key driver assembly upon changing the operation mode of the system.

12 Claims, 9 Drawing Sheets

PRIOR-ART

AUTOMATIC MUSIC PLAYER SYSTEM

FIELD OF THE INVENTION

This invention relates to an automatic music player system capable of producing a sound based on a musical information stored in a controller.

BACKGROUND OF THE INVENTION

An automatic music player system is known which includes a player piano capable of reproducing the musical information which has originated in the piano. Such musical information is produced by an operator keying-in on the keyboard of the piano and is converted into coded musical data, which are memorized into a memory during recording mode of operation of the system. For the reproduction of the musical information thus memorized into the memory, the coded musical data are read out and are converted into corresponding driver signals, which are then applied to the individual elements of solenoid-operated drive assemblies provided in association with the keyboard and the pedal mechanisms of the piano. The drive assemblies thus actuated drive the keys of the keyboard, the soft-pedal, tone-sustaining pedal and damper pedal and enable the piano to generate musical sounds conforming to the data received from the memory. The keyboard is accompanied by key action mechanism and tuned music wires which produce the acoustic sounds upon operator's keying-in.

A typical example of the automatic music player system is disclosed in Japanese Utility Model Application laid-open (Kokai) No. 56-5190 and illustrated in FIG. 1 of the drawings. The automatic music player system illustrated in FIG. 1 largely comprises an upright-type piano 1 and a controller 2 carrying a key driver assembly 3. As well known in the art, the upright-type piano has a keyboard provided with a plurality of keys, a key action mechanism linked with the keys and a plurality of tuned music wires each capable of producing a sound upon actuation of the key action mechanism. The upright-type piano further has three pedals consisting of a soft-pedal, a tone-sustaining pedal and a damper pedal and a pedal mechanism linked with the three pedals, and the pedal mechanism drives a damper mechanism upon operation of the pedals so as to affect the sounds produced by the music wires.

On the other hand, the controller 2 is provided within a case with casters movable in any direction and stores the coded musical data in a memory incorporated therein. The key driver assembly 3 is supported by the case and has a plurality of solenoid-operated key actuators equal in number to the keys of the key board. The automatic music player system further comprises solenoid-operated pedal actuators associated with the pedals. In a reproducing mode, the key driver assembly 3 is located over the keyboard of the upright-type piano 1 so that each of the solenoid-operated actuators projects the plunger thereof onto the upper surface of the corresponding key of the keyboard and to push the key. When the key driver assembly 3 is located at the above described position (which is hereinafter referred to as reproducing position), the solenoid-operated actuators for the pedals are also located over the respective pedals and have the respective plungers attached to the upper surface of the pedals, respectively. The key driver assembly 3 thus positioned is supplied from the controller 2 with the drive signals converted from the coded musical data and controls the projections of the plungers of the solenoid-operated actuators so that the key action mechanism and the pedal mechanism are selectively actuated to produce the fine musical sounds. In a recording mode, an operator needs to supply the controller 2 with a new musical information produced by operator's keying-in, sitting on a chair in front of the keyboard of the upright-type piano 1. With the new musical information, the controller 2 converts the new musical information into new coded musical data and stores the new coded musical data into the memory.

However, a problem is encountered in the prior-art automatic music player system in adjustment for locating the key driver assembly 3 at the reproducing position. Namely, the key driver assembly 3 is supported by the case where the controller 2 is received so that the operator needs to move the case in front of the keyboard and, thereafter, adjusts the key driver assembly 3 in such a manner that the individual plungers of the solenoid-operated actuators are brought into contact with the corresponding keys of the keyboard. However, the case carrying the key driver assembly 3 intervenes between the operator and the key board, then the operator hardly finds the reproducing position. Moreover, when the operator wants to go the recording mode, the case carrying the key driver assembly 3 should be replaced by the chair. The total weight of the case and the key driver assembly 3 is relatively heavy for easy replacement. This is another problem encountered in the prior-art automatic music player system. In addition to these problems, the case carrying the key driver assembly 3 deteriorates the external appearance of the traditional upright-type piano 1.

SUMMARY OF THE INVENTION

It is therefore an important object of the present invention to provide an automatic music player system which is easy to adjust a key driver assembly to the reproducing position.

It is also another important object of the present invention to provide an automatic music player system which is easy to change from the reproducing mode to the recording mode.

It is still another important object of the present invention to provide an automatic music player system which has an improved external appearance.

To accomplish these objects, the present invention proposes to separate the key driver assembly from the controller and couple them by using electric wires.

In accordance with the present invention, there is provided an automatic musical player system having at least a reproducing mode, comprising: (a) a piano having a key board provided with a plurality of keys, sound generator means operative to mechanically generate sounds when the keys are actuated, and effector means operative to affect the sound generated by the sound generator means upon actuation; (b) control means located at the outside of the piano and operative to produce drive signals based on the musical information stored therein in the reproducing mode; (c) a key driver assembly provided with a plurality of actuators corresponding to the keys, respectively, and responsive to the drive signal for selectively actuating the keys; (d) effector drive means responsive to the drive signal and operative to actuate the effector means; and (e) electric wires coupling the piano to the control means and electrically connecting the control means to the key driver assembly and the effector drive means, wherein the control means and the key driver assembly are physically separated from each other.

The automatic music player system may comprise a chair retaining said control means and providing a position where an operator sits during said recording mode, and the chair may further retain a source of electric power and the effector drive means. Each of the actuators may be formed by a solenoid-operated actuator having a plunger movable out of and into a casing, and the solenoid-operated actuator may be arranged to have a stroke shorter than a stroke of the corresponding key by a predetermined distance of, for example, about 0.5 millimeter. In order to adjust the gap between the key driver assembly and the key board, the automatic music player system may comprise an adjustment mechanism. The stroke of each plunger thus arranged results in that the key driver assembly would be bonded to the piano with an adhesive material.

The automatic music player system may further comprise a shifting mechanism allowing the key driver assembly to move between an open position angularly spaced apart from the key board and a closed position capable of actuating the keys of the key board, and the shifting mechanism may have a positioning device operative to fix the key driver assembly in the closed position.

BRIEF DESCRIPTION OF THE DRAWINGS

The features and advantages of an automatic music player system according to the present invention will be more clearly understood from the following description taken in conjunction with the accompanying drawings in which.

DESCRIPTION OF THE PREFERRED EMBODIMENTS

First Embodiment

Figure 1:
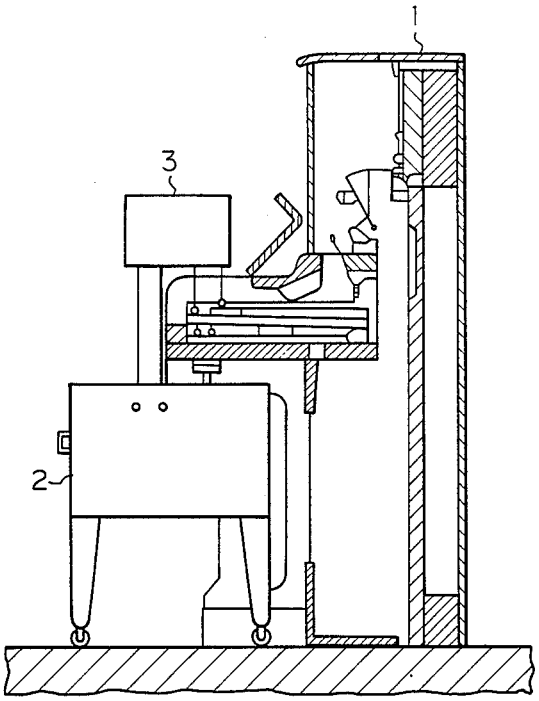
FIG. 1 is a partially cut-away view showing the automatic music player system disclosed in Japanese Utility Model Application laid-open No. 56-5190.
Figure 2:
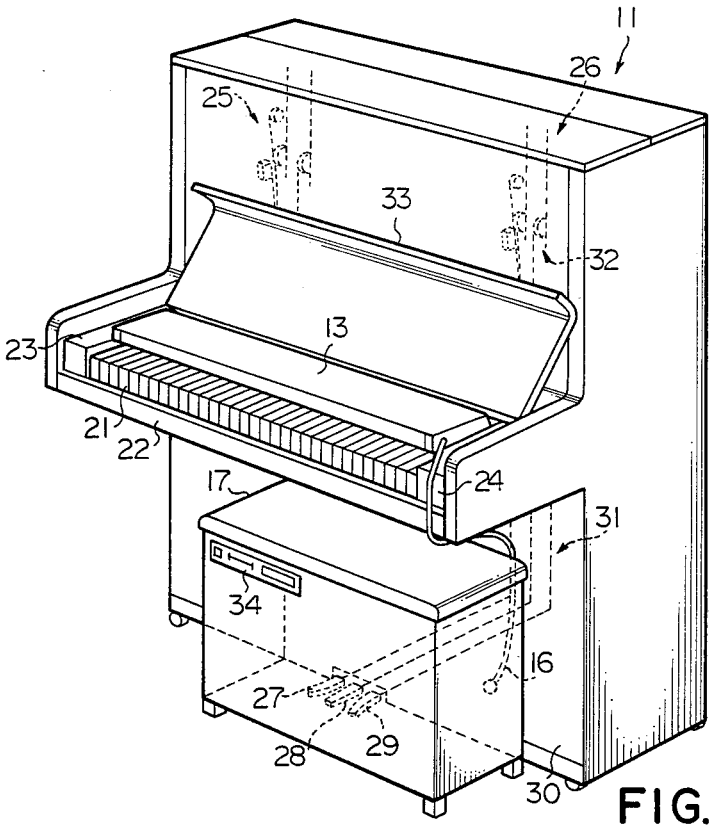
FIG. 2 is a perspective view showing a first embodiment of an automatic music player system according to the present invention.
Figure 3:
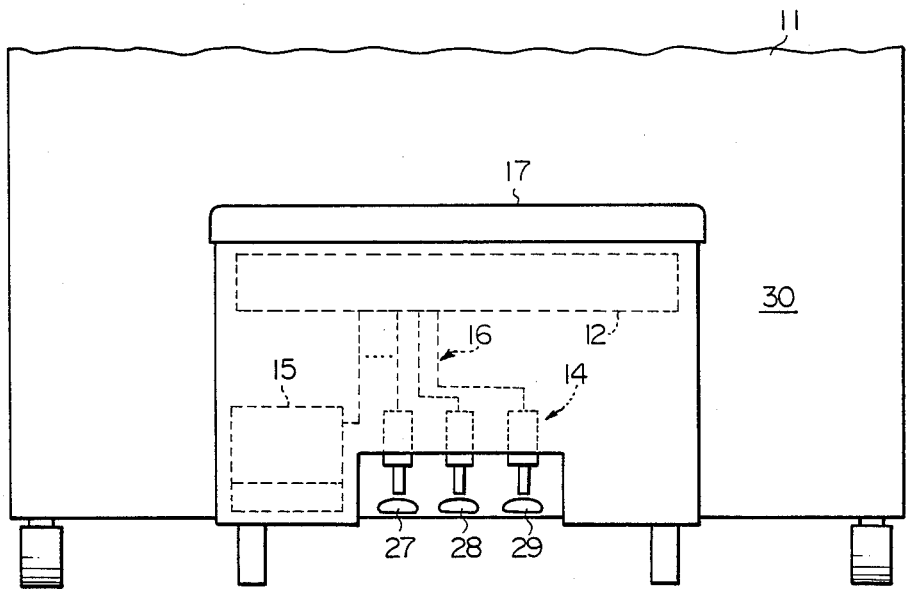
FIG. 3 is a front view showing a chair forming part of the automatic music player system illustrated in FIG. 2.
Figure 4:
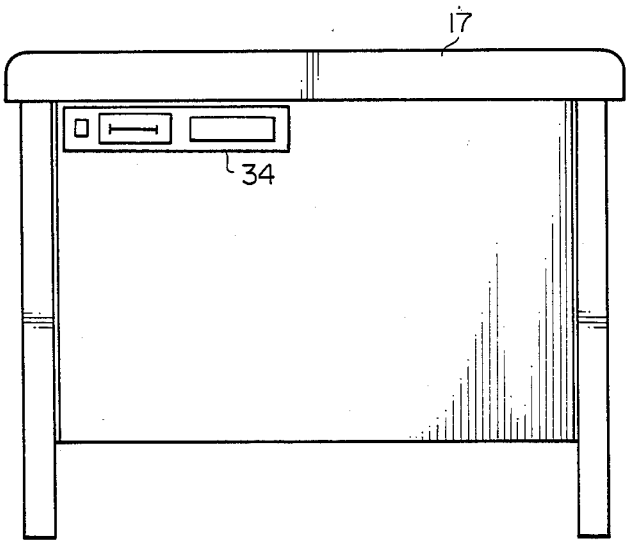
FIG. 4 is a rear view showing the chair illustrated in FIG. 3.

Referring first to FIGS. 2 to 4 of the drawings, an automatic music player system is illustrated and largely comprises an upright-type piano 11, a control unit 12, a key driver assembly 13, a pedal driver assembly 14, a battery or a transformer 15 serving as a source of electric power, electric wires 16 and a chair 17. The piano 11 comprises a keyboard 21 provided with a plurality of keys, typically eighty-eight keys, and mounted on a key bed 22. On the both sides of the keyboard 21 is provided a pair of key blocks 23 and 24 which support the key driver assembly 13. Though not shown in the drawings, the keyboard 21 is accompanied by a key action detectors each of which detects a motion of the key and supplies a key action signal to the control unit 12. The piano 11 further comprises a key action mechanism 25 operatively connected to the keys and transmitting the motions of the keys for striking tuned music wires 26, three pedals consisting of a soft-pedal 27, a tone-sustaining pedal 28 and a damper-pedal 29 and rockably projecting from a lower front board 30, a pedal action mechanism 31 transmitting motions of pedals for controlling damper mechanism 32, and a fall board 33 having an open position angularly spaced apart from the keyboard 21 and a closed position covering the keyboard 21. The three pedals 27, 28 and 29 are accompanied by pedal action detectors (not shown) each of which detects the motion of the corresponding pedal to produce a pedal action signal and the pedal action signal is supplied to the control unit 12. The key action signals and the pedal action signals represent a musical information. In this instance, the key action mechanism 25 and the tuned music wires 26 as a whole constitute sound generator means and the three pedals 27, 28 and 29, the pedal action mechanism 31 and the damper mechanism 32 as a whole constitute effector means.

As will be seen from FIGS. 3 and 4, the chair 17 has a hollow space in which the control unit 12, the pedal driver assembly 14 and the battery 15 is provided, so that the control unit 12 is physically separated from the key driver assembly 13 and the piano 11. The key driver assembly 13 has a plurality of solenoid-operated actuators each corresponding to each of the keys of the keyboard 21 and the pedal driver assembly 14 also has three solenoid-operated actuators corresponding to the three pedals 27, 28 and 29, respectively. As described above, the control unit 12 is separated from the key driver assembly 13 so that the electric wires 16 interconnect the control unit 12 and all of the solenoid-operated actuators of the key driver assembly 13 and the pedal driver assembly 14 for supplying drive signals produced by the control unit 12. The electric wires 16 also propagate the key action signals from the key action detectors of the piano 11 and the pedal action signals from the pedal action detectors to the control unit 12 and the control unit 12 converts these action signals into digital signals which is stored in a memory incorporated in therein. The chair also provides a position where an operator, or a performer, sits during keying-in on the keyboard 21.

The control unit 12 has a control panel 34 exposed to the outside of the chair 17 and the control panel 34 is provided with a mode selecting switch and other switches. The mode selecting switch is used for shifting the automatic musical player system among a recording mode, a reproducing mode and a normal playing mode. When the automatic music player system is shifted to the recording mode, the motions of the keys are detected by the key action detectors to produce the key action signals and the motions of the three pedals 27, 28 and 29 are also detected by the pedal action detectors, and all of the key action signals and the pedal action signals are supplied to the control unit 12 through the electric wires 16. With the key action signals fed from the key action detectors and the pedal action signals fed from the pedal action detectors, the control unit 12 produces a series of the digital signals representing the coded music data which is stored in the memory. On the other hand, when the automatic music player system is shifted to the reproducing mode, the control unit 12 reads out the digital signals from the memory and produces the drive signals based on the digital signals representing the coded data. The drive signals are supplied to the solenoid-operated actuators of the key driver assembly 13 and the pedal driver assembly 14 through the electric wires 16 for actuation, and the actuated solenoid-operated actuators drive the keys of the keyboard 21 and the three pedals 27, 28 and 29. Then, the piano plays the music without operator's keying-in on the key board 21. However, if the normal playing mode is selected by the mode selecting switch, the control unit remains in the non-active state, then the motions of keys and the pedals 27, 28 and 29 are transmitted only to the key action mechanism 25 and the pedal action mechanism 31, respectively, to mechanically generate the musical sounds. In the recording mode and the normal playing mode, the operator should remove the key driver assembly 13 prior to keying-in. The key driver assembly 13 is relatively light in comparison with the key drive assembly 3 combined with the controller 2, so that the operator easily starts the recording mode or the normal playing mode. If the operator wants the reproducing mode, the operator should place the key driver assembly 13 above the keyboard 21 and adjust the key driver assembly 13 in such a manner that all of the solenoid-operated actuators are precisely located above the corresponding keys of the keyboard 21, respectively. In this adjustment, the key driver assembly 13 is physically separated from the control unit 12 so that the operator can adjust the key driver assembly 13 while checking the locations of the solenoid-operated actuators. It is helpful for the operator to adjust the key driver assembly 13 in a short time. Moreover, the control unit is provided within the chair so that only the key driver assembly 13 is exposed. Then, the automatic music player system has an improved external appearance which in turn improves the commercial value of the automatic music player system.

Second Embodiment

Figure 5:
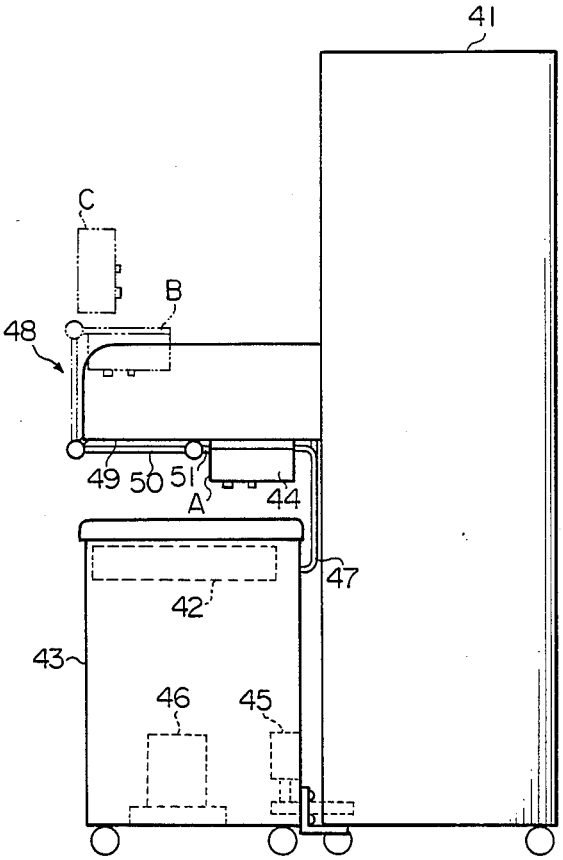
FIG. 5 is a side view showing a second embodiment of an automatic music player system according to the present invention.
Figure 6:
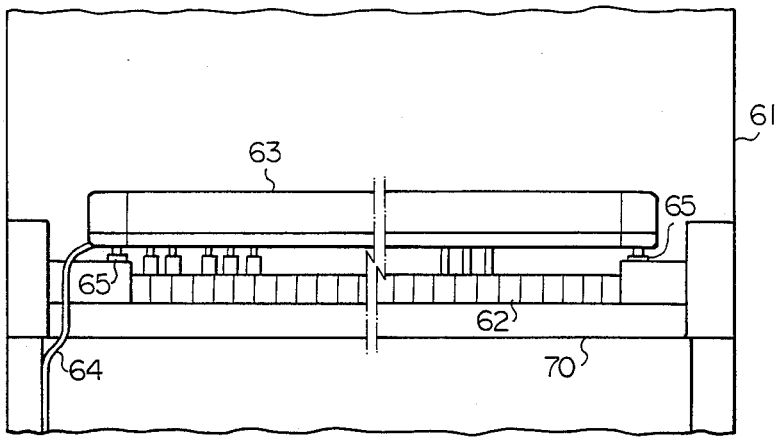
FIG. 6 is a front view showing a key driver assembly forming part of a third embodiment of an automatic music player system according to the present invention.

Turning to FIG. 5 of the drawings, there is shown another automatic music player system embodying the present invention. The automatic music player system illustrated in FIG. 5 largely comprises an upright-type piano 41, a control unit 42 housed in a chair 43, a key driver assembly 44, a pedal driver assembly 45, a battery 46 provided within the chair 43 and electric wires 47 coupling the control unit 42 to key action detectors and pedal action detectors of the piano 41, the key driver assembly 44 and the pedal driver assembly 45. The piano 41, the control unit 42, the key driver assembly 44, the pedal driver assembly 45, the battery 46 and the electric wires 47 are similar in construction to the piano 11, the control unit 12, the key driver assembly 13, the pedal driver assembly 14, the battery 15 and the electric wires 16 of the first embodiment, so that detailed description will be omitted for the sake of simplicity.

A particular feature of the automatic musical player system illustrated in FIG. 5 resides in the fact that the key driver assembly 44 is connected to a shifting mechanism 48 which in turn is connected to a key bed 49 of the piano 41. The shifting mechanism 48 comprises a first group of links 50 hingedly connected to the key bed 49 and a second group of links 51 hingedly connected at one end thereof to the first group of links 51 but rigidly fixed at the other end thereof to the key driver assembly 44. The shifting mechanism 48 thus arranged allows the key driver assembly 44 to angularly move between two positions "A" and "B". In detail, when the automatic music player system takes the recording mode or the normal playing mode, the links 50 are moved to a position immediately beneath the key bed 49 and the links 51 are stretched to be aligned with the links 50, then the key driver assembly 44 takes the position "A", exposing the upper surface of the keyboard of the piano 41. On the other hand, when the operator wants to shift the automatic music player system into the reproducing mode, the operator turns the links 50 to an upright position, then the key driver assembly 44 takes a transient position indicated by "C". Subsequently, the operator turns the links 51 over about 90 degrees so that the key driver assembly 44 is located at the position "B" where the key driver assembly 44 is adjusted in such a manner that all of the solenoid-operated actuators are precisely located above the corresponding keys of the keyboard. The automatic music player system illustrated in FIG. 5 has the key driver assembly 44 supported by the shifting mechanism 48 so that the operator can easily change the mode of the automatic music player system.

Third Embodiment

In FIGS. 6 to 10 is illustrated another automatic music player system which comprises an upright-type piano 61 provided with a keyboard 62, a control unit (not shown) housed in a chair (not shown), a key driver assembly 63, a pedal driver assembly (not shown), a battery (not shown) provided within the chair and electric wires 64 coupling the control unit to a key action detectors, pedal action detectors of the piano 61, the key driver assembly 63 and the pedal driver assembly. The piano 61, the key driver assembly 63 and other component elements are similar in construction to the piano 11, the key driver assembly 13 and the component elements of the first embodiment, so that detailed description will be omitted for the sake of simplicity.

Figure 7:
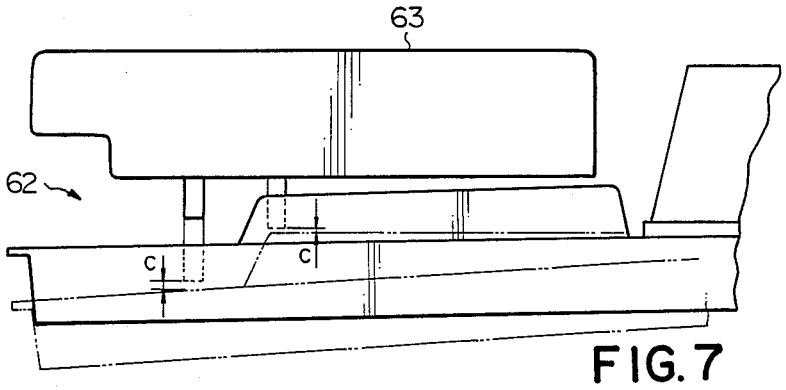
FIG. 7 is a side view showing the key driver assembly illustrated in FIG. 6.
Figure 8:
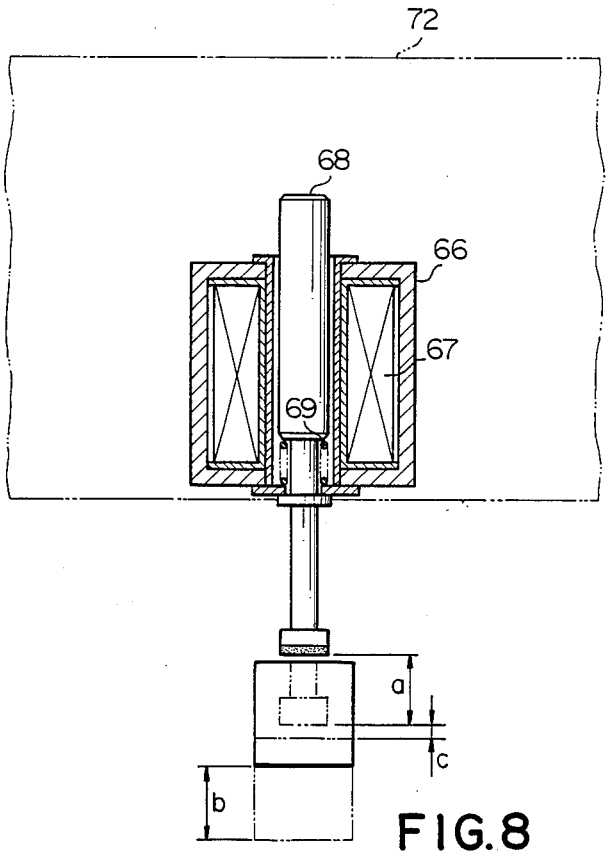
FIG. 8 is a cross sectional view showing a solenoid-operated actuator incorporated in the key driver assembly illustrated in FIG. 6.
Figure 9:
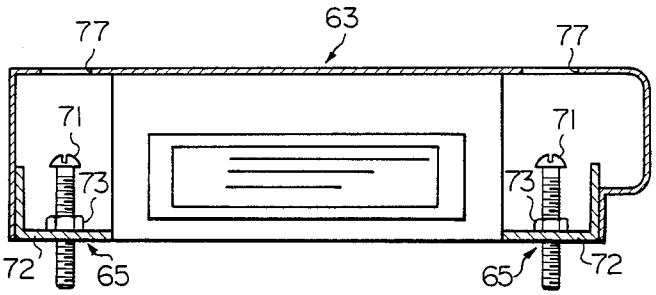
FIG. 9 is a cross sectional view showing a casing associated with an adjustment mechanism incorporated in the automatic music player system illustrated in FIG. 6.
Figure 10:
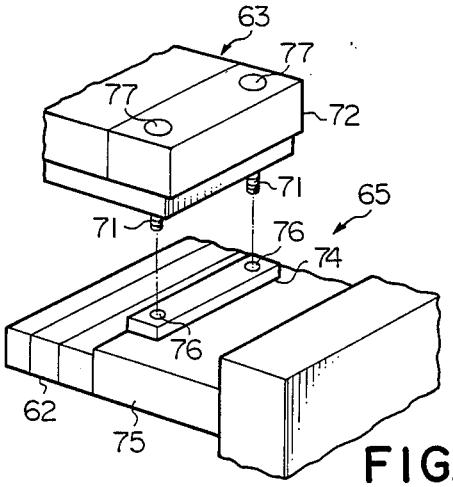
FIG. 10 is a perspective view showing the adjustment mechanism illustrated in FIG. 9.

The automatic music player system illustrated in FIGS. 6 to 10 further comprises an adjustment mechanism 65 which is operative to adjust a gap indicated by "c" in FIG. 7. In detail, the key driver assembly 63 is provided with a plurality of solenoid-operated actuators each located above each of the keys of the keyboard 62, and all of the solenoid-operated actuators are similar in construction to one another, then one of the solenoid-operated actuators is described with reference to FIG. 8. The solenoid-operated actuator illustrated in FIG. 8 comprises a casing 66 retaining a solenoid 67, a plunger 68 passing through the solenoid 67 and alternatively taking a retracted position or a projecting position, and a coil spring 69 resiliently urging the plunger 68 to the retracted position. The solenoid-operated actuator thus arranged projects the plunger 68 against the coil spring 69 when the solenoid 67 is energized. On the other hand, when the solenoid 67 is deenergized, the plunger 68 is moved into the retracted position by the agency of the coil spring 69. Then, the solenoid-operated actuator has a stroke "a" measuring between the retracted position and the projecting position. While the key forming part of the keyboard 62 is rockably moved with respect to a key bed 70 so that the key has a stroke "b" at that point where the plunger 68 is brought into contact. If the stroke "a" is longer than the stroke "b", the solenoid-operated actuator continues to press the key after reaching the lower dead point of the key. In this situation, the key driver assembly 63 is liable to be lifted up with the reaction of the pressing. However, the solenoid-operated actuator of the automatic music player system illustrated in FIG. 6 has a stroke "a" shorter than the stroke "b" by a distance of, for example, 0.5 millimeter, so that no large force is exerted to the key driver assembly 63. Moreover, the automatic music player system illustrated in FIG. 6 has the adjustment mechanism 65 which comprises four bolts 71 loosely passing through bolt openings (not shown) formed in both side portions of a casing 72 forming part of the key driver assembly 63, four nuts 73 each screwed into each of the bolts 71 for adjusting the projection of the bolt 71 from the lower surface of the casing 72, and two plates 74. Each of the two plates 74 is bonded to one of the key blocks 75 with an adhesive material and has two tapped holes 76 which receive the bolts 71, respectively. In the upper portions of the casing 72 are formed four through holes 77 which are aligned with the bolt openings for the four bolts 71, so that an operator can screw the bolts 71 into the tapped holes 76 with a screwdriver until the nuts 73 are brought into contact with the casing 72, respectively. In this manner, the operator fixes the key driver assembly 63 upon the piano 61. As described above, the adjusting mechanism 65 has the nuts 73 for adjusting the projection of the bolts 71 so that the gap "c" can be changed by turning the nuts 73. This means that a solenoid-operated actuator with any stroke can be used in the key driver assembly 63. Moreover, only a small force is exerted to the key driver assembly 63 so that it is not necessary for the casing 72 to have a great strength. This results in reduction in weight, so that the operator can easily carry the key driver assembly 63 to the reproducing position.

Fourth Embodiment

Figure 11:
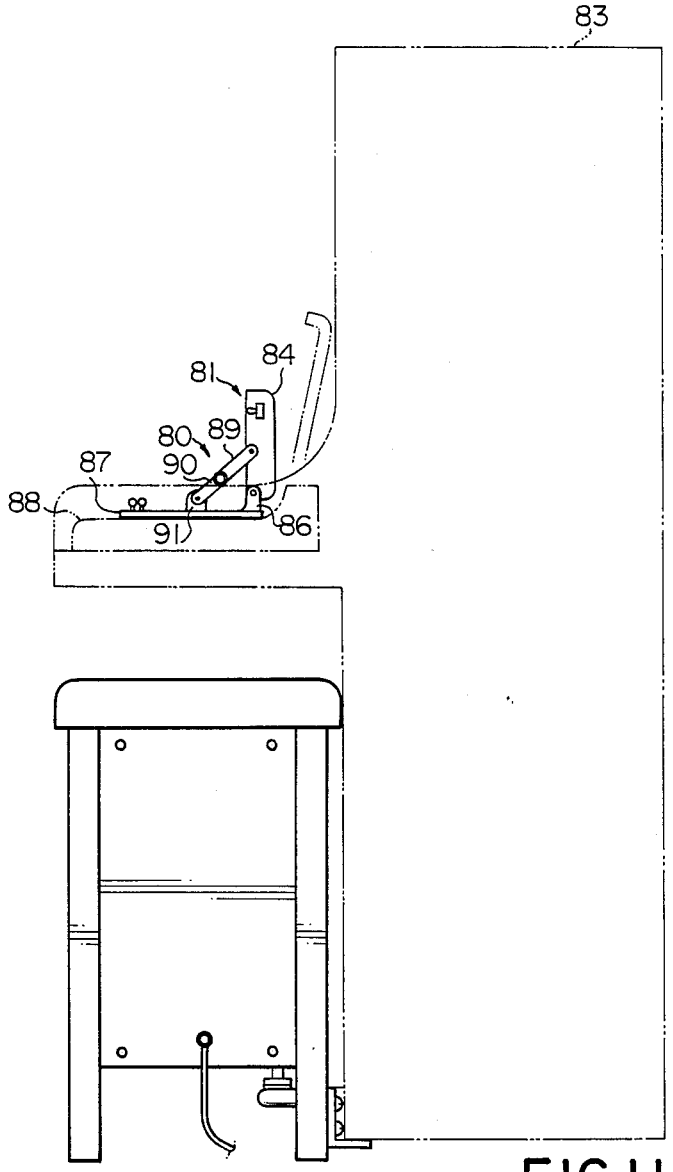
FIG. 11 is a side view showing a fourth embodiment of an automatic music player system according to the present invention.
Figure 13:
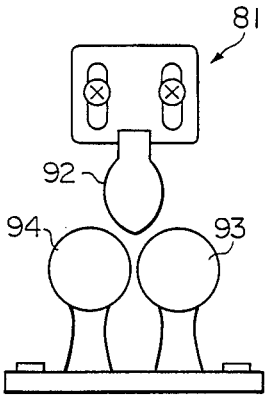
FIG. 13 is a front view showing a positioning device incorporated in the automatic music player system illustrated in FIG. 11.
Figure 12:
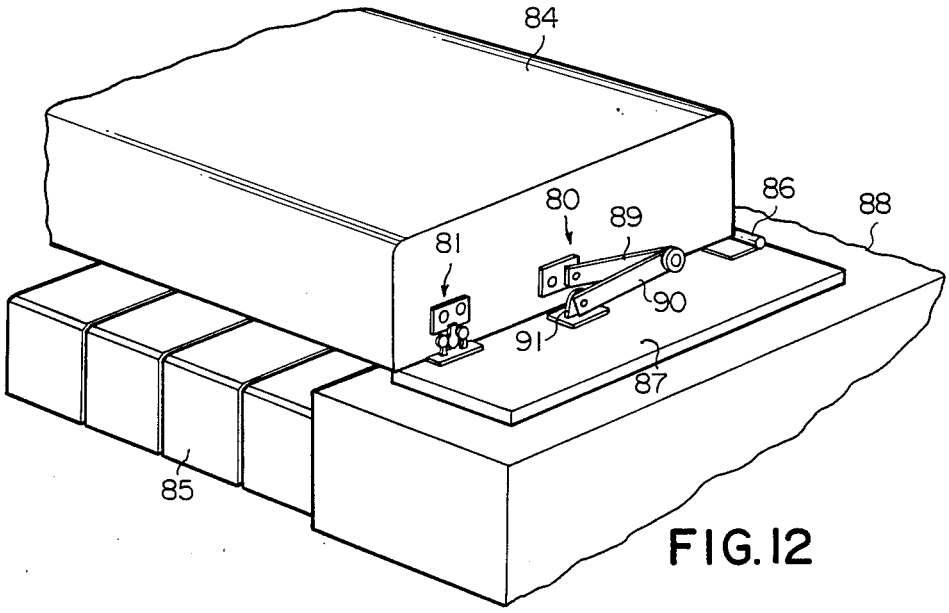
FIG. 12 is a perspective view showing the automatic music player system illustrated in FIG. 11.

Turning to FIGS. 11 to 13 of the drawings, there is shown still another automatic music player system embodying the present invention. The automatic music player system illustrated in FIGS. 11 to 13 is similar in construction to the automatic music player system shown in FIG. 2 except for a shifting mechanism 80 and a positioning mechanism 81. Then, description for the fourth embodiment is focused upon these two mechanisms 80 and 81. The shifting mechanism 80 is provided on an upright-type piano 83 and operative to angularly shift a key driver assembly 84 between an open position and a closed position. When the key driver assembly 84 is shifted into the open position, the key driver assembly 84 is angularly spaced apart from the keyboard 85 of the pian 83, so that the keyboard 85 is exposed to an operator for keying-in. On the other hand, when the key driver assembly 84 is shifted to the closed position, the key driver assembly 84 is automatically adjusted to the reproducing position, positioning the individual solenoid-operated actuators thereof precisely above the corresponding keys of the keyboard 85, respectively. In this instance, the shifting mechanism 80 comprises hinges 86 connected at one end thereof to the key driver assembly 84 and at the other end thereof to plate members 87 bonded to the key blocks 88 of the piano 83 with an adhesive material, and two sets of link members 89 and 90 hingedly connected at one ends thereof to each other. FIGS. 11 and 12 show only one set of the link members 89 and 90 provided on the left side of the key driver assembly 84. However, the other set of link members is provided on the right side of the key driver assembly. The link member 89 has the other end hingedly connected to the intermediate portion of the key driver assembly 84 but the link member 90 is hingedly connected at the other end thereof to a block member 91 which is fixed to the plate member 87. When the operator wants to play the piano, the operator turns the key driver assembly 84 around the hinges 86, then the the key driver assembly 84 is angularly moved while the link members 89 and 90 turn to be aligned with each other. Finally, the key drive assembly 84 takes the open position and the operator can begin to play the piano 83. On the other hand, if the operator wants to reproduce the music, the operator turns the key driver assembly 84 in the opposite direction. Then, the key driver assembly 84 is angularly moved around the hinges 86 while the other end of the link member 89 is getting nearer to the other end of the link member 90. As a result, the key driver assembly 84 automatically takes the reproducing position.

When the key driver assembly 84 selectively actuates the keys of the keyboard 85 in the reproducing mode, the key driver assembly 84 is liable to be lifted up with the reaction of pressing. However, the automatic music player system illustrated in FIGS. 11 to 13 is equipped with the positioning mechanism 81 to prevent the key driver assembly 84 from undesirable movement. In this instance, the positioning mechanism 81 comprises a projection member 92 fixed to the key driver assembly 84 and two upright members 93 and 94 as will be better seen from FIG. 13. The projection member 92 has a spade-shaped configuration and the upright members 93 and 94 have respective round head portions slightly spaced apart from each other. The round head portions are respectively supported by resiliently deformable stem portions. For this reason, when the projection member 92 is forcibly inserted into a gap between the round head portions of the upright members 93 and 94, the gap between the round head portions is increased to pass the projection member 92 and, then, the projection member 92 reaches a wide gap between the stem portions of the upright members 93 and 94. This means that the projection member 92 is fastened by the upright members 93 and 94, so that the key driver assembly 84 is fixed in the closed position.

All of the embodiments are implemented by the upright-type pianos, however each of the upright-type piano is replacable by a grand-type piano.

It is also desirable that each of the chairs has casters for easy movement.

Although particular embodiment of the present invention have been shown and described, it will be obvious to those skilled in the art that various changes and modifications may be made without departing from the spirit and scope of the present invention.

What is claimed is:

1. An automatic music player system having at least a reproducing mode, comprising:

(a) a piano having a keyboard provided with a plurality of keys, sound generator means operative to mechanically generate sounds when the keys are actuated, and effector means operative to affect the sound generated by the sound generator means upon actuation;

(b) control means located at the outside of said piano and operative to produce drive signals based on the musical information stored therein in said reproducing mode;

(c) a key driver assembly provided with a plurality of actuators corresponding to said keys, respectively, and responsive to said drive signal for selectively actuating said keys;

(d) effector drive means responsive to said drive signal and operative to actuate said effector means;

(e) electric wires coupling said piano to said control means and electrically connecting said control means to said key driver assembly and said effector drive means, said control means and said key driver assembly being physically separated from each other; and (f) a shifting mechanism allowing said key driver assembly to move between an open position angularly spaced apart from said keyboard and a closed position capable of actuating the keys of said keyboard, in which each of said actuators is of a solenoid-operated type having a plunger movable out of and into a casing and in which said plunger has a stroke shorter than a stroke of said corresponding key.

2. An automatic music player system as set forth in claim 1, in which said automatic music player system further comprises a chair retaining said control means and providing a position where an operator sits when the operator plays said piano.

3. An automatic music player system as set forth in claim 2, in which said chair further retains a source of electric power.

4. An automatic music player system as set forth in claim 2, in which said chair further retains said effector drive means.

5. An automatic music player system as set forth in claim 1, in which a difference in stroke between said plunger and said key is about 0.5 millimeter.

6. An automatic music player system as set forth in claim 1, in which said automatic music player system further comprises an adjustment mechanism for adjusting a gap between said key driver assembly and said keyboard.

7. An automatic music player system as set forth in claim 1, in which said shifting mechanism has a positioning device operative to fix said key driver assembly in the closed position.

8. An automatic music player system as set forth in claim 1, in which said automatic music player system further has a recording mode, and in which said control means are operative to store a musical information produced by a keying-in on said keyboard.

9. An automatic music player system having at least a reproducing mode, comprising:

(a) a piano having a keyboard provided with a plurality of keys, sound generator means operative to mechanically generate sounds when the keys are actuated, and effector means operative to affect the sound generated by the sound generator means upon actuation;

(b) control means operative to produce drive signals based on the musical information stored therein in said reproducing mode;

(c) a key driver assembly set on said piano and provided with a plurality of solenoid-operated actuators respectively corresponding to said keys and having respective plungers projecting toward the corresponding key, said key driver assembly being responsive to said drive signal for selectively actuating said keys;

(d) effector drive means responsive to said drive signal and operative to actuate said effector means;

(e) electric wires coupling said piano to said control means and electrically connecting said control means to said key driver assembly and said effector drive means;

(f) a chair retaining said control means, said effector drive means and a source of electric power and providing a position wherein an operator sits when the operator plays said piano; and (g) a shifting mechanism allowing said key driver assembly to move between an open position angularly spaced apart from said keyboard and a closed position capable of actuating the keys of said keyboard, wherein the plunger of each solenoid-operated actuator has a stroke shorter than a stroke of said corresponding key.

10. An automatic music player system having at least a reproducing mode, comprising:

(a) a piano having a keyboard provided with a plurality of keys, sound generator means operative to mechanically generate sounds when the keys are actuated, and effector means operative to affect the sound generated by the sound generator means upon actuation;

(b) control means operative to produce drive signals based on the musical information stored therein in said reproducing mode;

(c) a key driver assembly set on said piano and provided with a plurality of solenoid-operated actuators respectively corresponding to said keys and having respective plungers projecting toward the corresponding key, said key drive assembly being responsive to said drive signal for selectively actuating said keys, said plunger of each solenoid-operated actuator having a stroke shorter than a stroke of said corresponding key;

(d) effector drive means responsive to said drive signal and operative to actuate said effector means;

(e) electric wires coupling said piano to said control means and electrically connecting said control means to said key driver assembly and said effector drive means;

(f) a chair retaining said control means, said effector drive means and a source of electric power and providing a position where an operator sits when the operator plays the piano; and (g) a shifting mechanism allowing said key drive assembly to move between an open position angularly spaced apart from said keyboard and a closed position capable of actuating the keys of said keyboard, said shifting means having a positioning device operative to fix said key driver assembly in the closed position.

11. An automatic music player system having at least a recording mode and a reproducing mode, comprising:

(a) a piano having a keyboard provided with a plurality of keys, sound generator means operative to mechanically generate sounds when the keys are actuated, and effector means operative to affect the sound generated by the sound generator means upon actuation;

(b) control means operative to store a musical information produced by a keying-in on said keyboard and an operation of said effector means in said recording mode and to produce drive signals based on the musical information stored therein in said reproducing mode;

(c) a key driver assembly set on said piano and provided with a plurality of solenoid-operated actuators respectively corresponding to said keys and having respective plungers projecting toward the corresponding key, said key driver assembly being responsive to said drive signal for selectively actuating said keys;

(d) effector drive means responsive to said drive signal and operative to actuate said effector means;

(e) electric wires coupling said piano to said control means and electrically connecting said control means to said key driver assembly and said effector drive means; and (f) a chair retaining said control means, said effector drive means and a source of electric power and providing a position where an operator sits during said recording mode, wherein the plunger of each solenoid-operated actuator has a stroke shorter than a stroke of said corresponding key.

12. An automatic music player system having at least a recording mode and a reproducing mode, comprising:

(a) a piano having a keyboard provided with a plurality of keys, sound generator means operative to mechanically generate sounds when the keys are actuated, and effector means operative to affect the sound generated by the sound generator means upon actuation;

(b) control means operative to store a musical information produced by a keying-in on said keyboard and an operation of said effector means in said recording mode and to produce drive signals based on the musical information stored therein in said reproducing mode;

(c) a key driver assembly set on said piano and provided with a plurality of solenoid-operated actuators respectively corresponding to said keys and having respective plungers projecting toward the corresponding key, said key drive assembly being responsive to said drive signal for selectively actuating said keys, said plunger of each solenoid-operated actuator having a stroke shorter than a stroke of said corresponding key;

(d) effector drive means responsive to said drive signal and operative to actuate said effector means;

(e) electric wires coupling said piano to said control means and electrically connecting said control means to said key driver assembly and said effector drive means;

(f) a chair retaining said control means, said effector drive means and a source of electric power and providing a position where an operator sits during said recording mode; and (g) a shifting mechanism allowing said key drive assembly to move between an open position angularly spaced apart from said keyboard and a closed position capable of actuating the keys of said keyboard, said shifting means having a positioning device operative to fix said key driver assembly in the closed position.

* * * * *